US007097264B2

(12) United States Patent
Saito et al.

(10) Patent No.: US 7,097,264 B2
(45) Date of Patent: Aug. 29, 2006

(54) PRINTING APPARATUS AND PRINTING APPARATUS CONTROL METHOD

(75) Inventors: Hiroyuki Saito, Kanagawa (JP); Nobutsune Kobayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 10/650,728

(22) Filed: Aug. 29, 2003

(65) Prior Publication Data

US 2004/0041854 A1 Mar. 4, 2004

(30) Foreign Application Priority Data

Aug. 29, 2002 (JP) ..... 2002-251451

(51) Int. Cl.
*B41J 29/38* (2006.01)
*B41J 23/00* (2006.01)

(52) U.S. Cl. ..... 347/5; 347/16; 347/37

(58) Field of Classification Search ..... 347/5, 347/9, 19, 104, 17, 16, 37; 318/560, 561, 318/430–434, 685, 696, 34
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
4,740,796 A 4/1988 Endo et al.
5,940,105 A * 8/1999 Hayami ..... 347/104
5,998,956 A * 12/1999 Saito ..... 318/696
6,015,202 A * 1/2000 Hiramatsu et al. ..... 347/32
6,515,445 B1 2/2003 Shoji et al.
6,599,043 B1 7/2003 Kobayashi et al.
2002/0051670 A1 5/2002 Saito
2002/0171702 A1 11/2002 Kobayashi et al.
2002/0172510 A1 11/2002 Kobayashi et al.
2002/0172511 A1 11/2002 Saito et al.

FOREIGN PATENT DOCUMENTS

JP 5-254217 10/1993

* cited by examiner

*Primary Examiner*—Stephen Meier
*Assistant Examiner*—Geoffrey S. Mruk
(74) *Attorney, Agent, or Firm*—Fitzpatrick, Cella, Harper & Scinto

(57) ABSTRACT

In a printing apparatus which prints using a printhead, a printing controller for feedback-controlling driving of the printing apparatus includes a control information generation unit which generates control information for controlling driving of a motor on the basis of the first driving pattern, a comparison unit which compares the control information and a threshold for determining an overload on driving of the motor, and a setting unit which sets the second driving pattern for changing a load on driving of the motor by the control information, instead of the first driving pattern, on the basis of the comparison result of the comparison unit. Control of the motor is switched in accordance with the load state.

4 Claims, 8 Drawing Sheets

PRINTING APPARATUS AND PRINTING APPARATUS CONTROL METHOD

FIELD OF THE INVENTION

The present invention relates to a printing apparatus which forms an image on a printing medium and, more particularly, to a printing apparatus which adopts a DC motor as a driving means and a method of controlling the printing apparatus.

BACKGROUND OF THE INVENTION

With recent higher-image-quality, higher-speed ink-jet printing apparatuses, many printing apparatuses employ a DC motor as a driving source, and adopt servo control capable of feeding back position detection information of an encoder to perform high-precision position control and high-speed driving.

Control using a DC motor can realize driving by high-speed rotation without any step-out, unlike control using a pulse motor.

Position information of the motor can be detected at high precision by using an encoder signal. The detected information is fed back to a motor control rule to control the velocity, and thus positioning to a target position can be performed at high precision.

The printing velocity of a printing apparatus has conventionally been controlled on the basis of several settings determined in advance. For example, as for the printing velocity, printing modes such as a high-quality mode which realizes a normal printing quality, a high-speed mode which realizes high-speed printing, and a super-high-quality mode which realizes the highest quality are provided. Settings with different carriage driving velocities and different convey velocities for conveying a printing medium are determined in advance for the respective printing modes.

The driving velocity of the motor in each mode is determined from many factors such as the relationship between the motor torque and the load of the mechanical system, noise generated upon driving, sheet feed performance, and ink discharge frequency. Particularly in a mode which realizes high-speed printing, the driving velocity is determined on the basis of the relationship (torque margin) between the motor torque and the load of the mechanical system. Control for driving the motor is executed with a predetermined margin so as to prevent driving of the motor from becoming an overload to the rated torque.

In order to ensure a torque margin, a motor operation profile (control command) is so determined as to assure operation under the worst imaginable load condition (maximum load). The DC motor is servo-controlled on the basis of the determined operation velocity and acceleration/deceleration pattern.

A conventional printing apparatus assumes a use form in the worst environment or state, and sets the operation profile of each mode with a margin for the performance of the DC motor so as to keep a predetermined printing quality and printing velocity in order to assure predetermined operation even in the worst state. Printing apparatuses are spread worldwide, and various temperature environments and use frequencies are assumed. Depending on the operation pattern, an unnecessarily large margin may be ensured (over-specification).

SUMMARY OF THE INVENTION

The present invention has been proposed to solve the conventional problems, and has as its object to provide a printing apparatus to which control efficiently using the motor performance which sets a torque margin in accordance with the use situation without ensuring any unnecessarily large margin is applied in accordance with the use environment and state, and a method of controlling the printing apparatus.

To achieve the above object, a printing apparatus and a method of controlling the printing apparatus according to the present invention mainly have the following arrangement and steps.

The above-described object of the present invention is achieved by a printing apparatus which prints using a printhead, wherein a printing controller for feedback-controlling driving of the printing apparatus comprises:

control information generation means for generating control information for controlling driving of a motor on the basis of a first driving pattern;

comparison means for comparing the control information and a threshold for determining an overload on driving of the motor; and setting means for setting a second driving pattern, instead of the first driving pattern, on the basis of a comparison result of the comparison means.

The above-described object of the present invention is achieved by a printing apparatus control method of driving, on the basis of feedback control, a printing apparatus which prints using a printhead, comprising:

a control information generation step of generating control information for controlling driving of a motor on the basis of a first driving pattern;

a comparison step of comparing the control information and a threshold for determining an overload on driving of the motor; and a setting step of setting a second driving pattern, instead of the first driving pattern, on the basis of a comparison processing result of the comparison step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

The following embodiments will exemplify a printer as a printing apparatus using an ink-jet printing method.

In this specification, "printing" (to be also referred to as "print") is to form an image, design, pattern, or the like on a printing medium or process a medium regardless of whether to form significant information such as a character or figure, whether information is significant or insignificant, or whether information is so visualized as to allow a user to visually perceive it.

"Printing media" are not only paper used in a general printing apparatus, but also ink-receivable materials such as cloth, plastic film, metal plate, glass, ceramics, wood, and leather.

"Ink" (to be also referred to as "liquid") should be interpreted as broadly as the definition of "printing (print)". "Ink" represents a liquid which is applied to a printing medium to form an image, design, pattern, or the like, process the printing medium, or contribute to ink processings (e.g., solidification or insolubilization of a coloring material in ink applied to a printing medium).

First Embodiment

Figure 1:
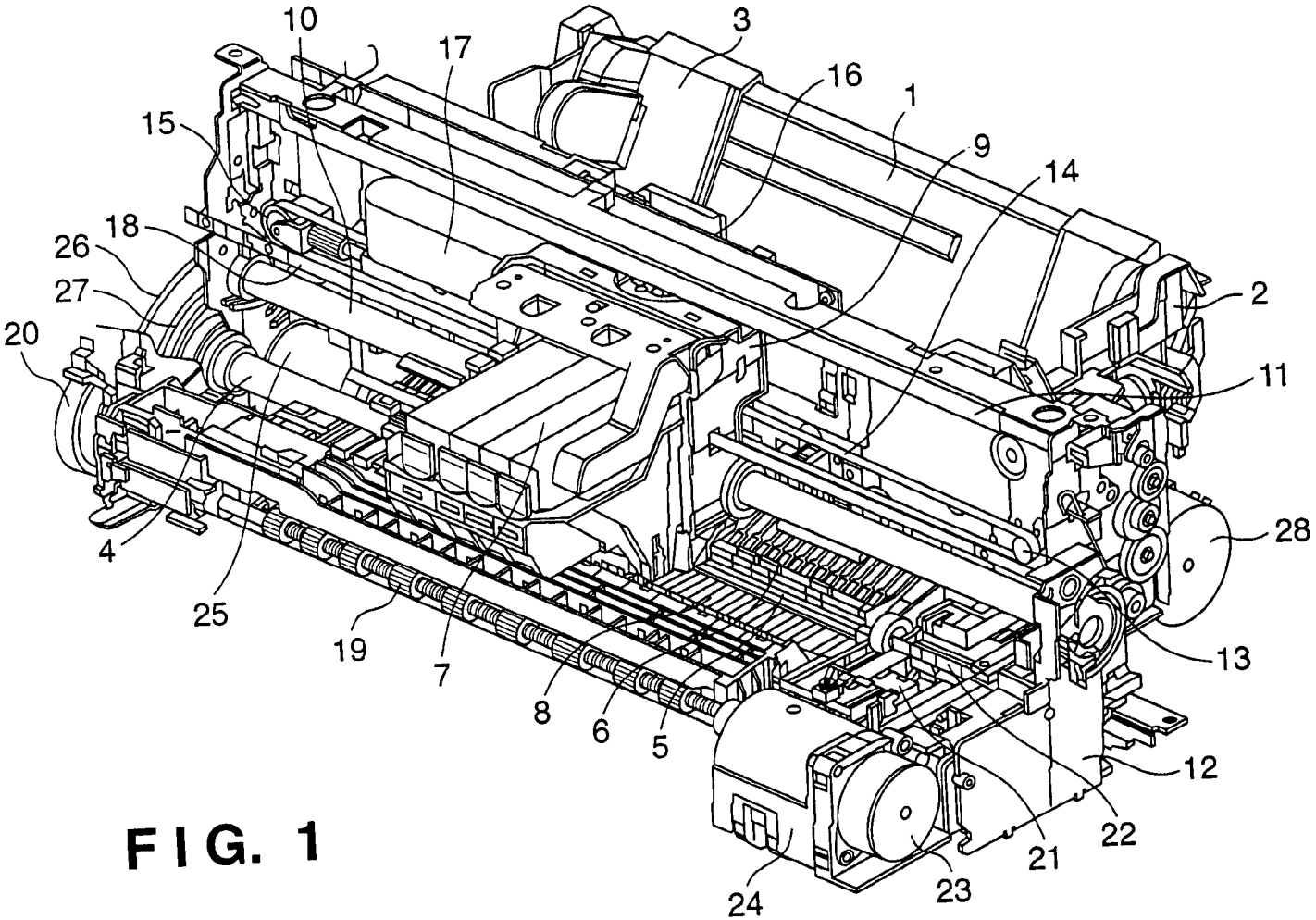
FIG. 1 is a perspective view showing the mechanical part of a printing apparatus according to the first embodiment.
Figure 2:
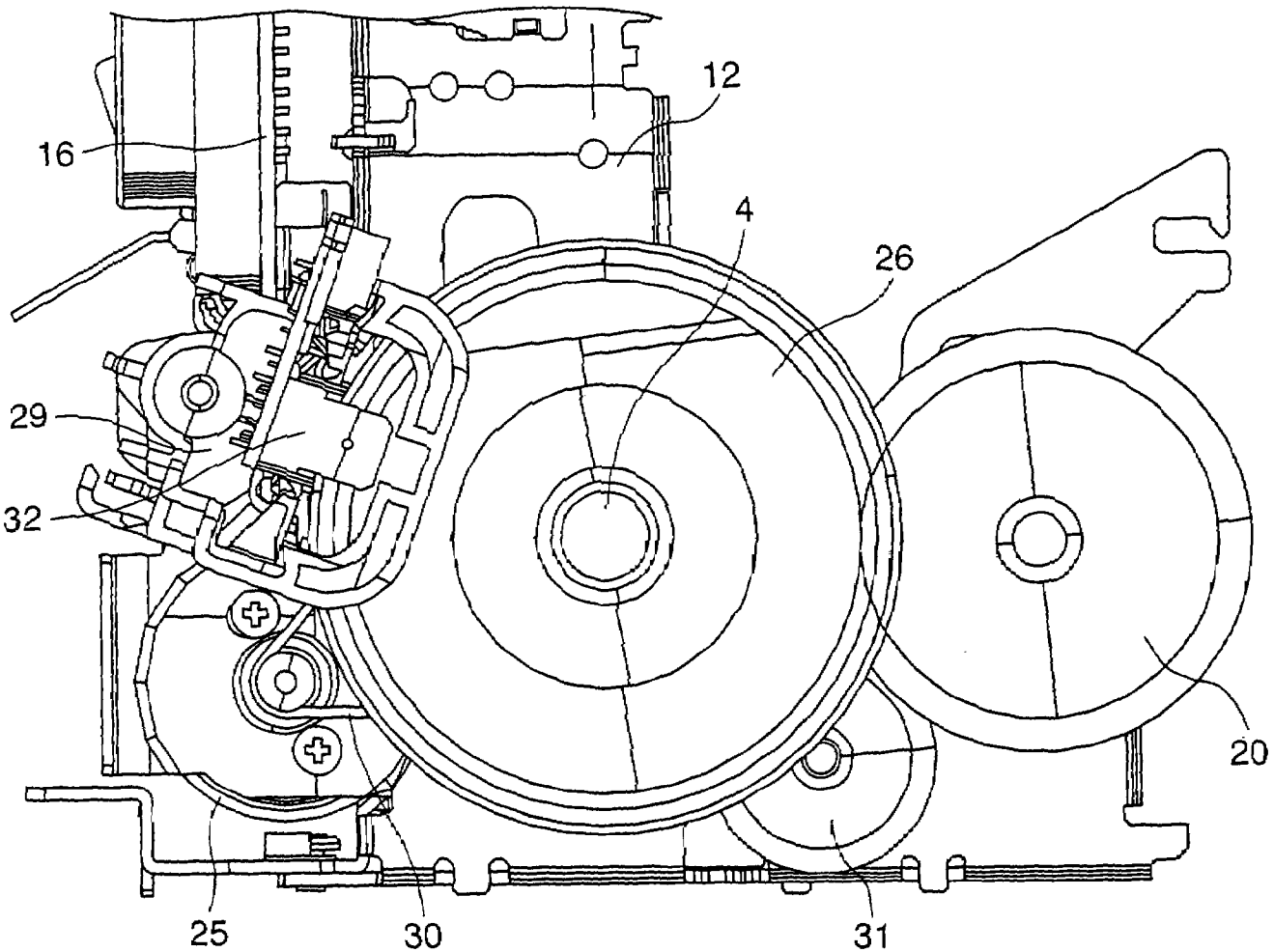
FIG. 2 is a side view showing the convey driving part of the printing apparatus according to the first embodiment.

FIG. 1 is a perspective view showing the whole arrangement of a printing apparatus. FIG. 2 is a side view showing a convey driving system which conveys a printing medium. The whole arrangement of the printing apparatus shown in FIG. 1 is constituted by five sections (A) to (E) (to be described later): an auto sheet feed section, sheet supply section, delivery section, carriage section, and cleaning section. These sections will be schematically explained separately.

(A) Auto Sheet Feed Section

The auto sheet feed section is constituted by attaching, to a base 2, a stacker 1 on which printing media are stacked and a sheet feed roller (not shown) which feeds a printing medium. A movable side guide 3 is movably attached to the stacker 1, and regulates a printing medium stacking position. The stacker 1 can rotate about a shaft coupled to the base 2, and is biased to the sheet feed roller by a stacker spring (not shown).

Printing media are conveyed by the driving force of a sheet feed motor 28 to a nip portion which is comprised of the sheet feed roller and a separation roller (not shown). The conveyed printing media are separated at the nip portion, and only the uppermost printing medium is conveyed.

(B) Sheet Supply Section

The sheet supply section comprises a convey roller 4 which conveys a printing medium, and a sheet position sensor (not shown). A driven pinch roller 5 abuts against the convey roller 4. The pinch roller 5 is held by a pinch roller guide 6, and biased by a pinch roller spring (not shown) to abut against the convey roller 4, producing a printing medium convey force. A head cartridge 7 which forms an image on the basis of image information is arranged on the downstream side (printing medium discharge side) in the printing medium convey direction of the convey roller 4. A convey encoder sensor 32 is fixed to a convey encoder sensor holder 29, and the holder 29 is attached to a chassis 12. The driving force of a convey motor 25 is transmitted via a convey timing belt 30 to a convey roller gear 27 which is press-fixed to the convey roller 4.

The convey encoder sensor 32 reads the line count of a convey encoder scale 26 which is inserted into the convey roller 4 and fixed to the convey roller gear 27. Feedback control is performed on the basis of rotation amount (velocity) information of the convey roller 4 obtained from the line count, and the convey motor 25 which is a DC motor is rotated and controlled to convey a printing medium. The printing medium conveyed to the sheet supply section is guided by the pinch roller guide 6 and a paper guide (not shown), and supplied to the pair of convey roller 4 and pinch roller 5. At this time, the sheet position sensor detects the leading end of the conveyed printing medium to obtain the printing position of the printing medium. In printing, a printing medium is conveyed on a platen 8 by rotation of the pair of rollers 4 and 5.

(C) Carriage Section

The carriage section comprises a carriage 9 which holds the head cartridge 7. The carriage 9 is supported by a guide shaft 10 for reciprocally scanning the carriage 9 in a direction almost perpendicular to the printing medium convey direction, and a guide rail 11 which holds the upper rear end of the carriage 9 and maintains a gap between the printhead 7 and a printing medium. The guide shaft 10 and guide rail 11 are attached to the chassis 12. The carriage 9 is driven via a timing belt 14 by a carriage motor 13 which is a DC motor attached to the chassis 12. The timing belt 14 is supported at a predetermined tension by an idle pulley 15.

The carriage 9 comprises a flexible cable 17 for transmitting from an electric board 16 to the head cartridge 7 a signal for controlling the printhead. The carriage 9 supports a linear encoder (not shown) which detects the position of the carriage. The position of the carriage 9 can be detected by reading the line count of a linear scale 18 attached to the chassis 12. A signal from the linear scale 18 is transmitted to the electric board 16 via the flexible cable 17, and processed.

To form an image on a printing medium in the above arrangement, the printing medium is conveyed by the pair of rollers 4 and 5 to a row position (position in the printing medium convey direction) where an image is to be formed. By the carriage motor 13 and feedback control using the linear encoder, the carriage 9 is moved to a column position (position perpendicular to the printing medium convey direction) where an image is to be formed. As a result, the head cartridge 7 faces the image formation position. The head cartridge 7 discharges ink to the printing medium in accordance with a signal from the electric board 16 to form an image.

(D) Delivery Section

In the delivery section, a spur gear (not shown) abuts against a delivery roller 19 so as to rotate following the delivery roller 19. The delivery roller 19 receives a driving force from the convey roller gear 27 via a delivery transmission gear 31 and delivery roller gear 20. With this arrangement, a printing medium on which an image is formed by the carriage section by driving is pinched by a nip between the delivery roller 19 and the spur gear, conveyed, and discharged onto a delivery tray (not shown) or the like.

(E) Cleaning Section

The cleaning section is comprised of a pump 24 which cleans the head cartridge 7, a cap 21 for preventing drying of the head cartridge 7, a wiper 22 which cleans the face of the head cartridge 7, and a PG motor 23 serving as a driving source.

<Control of Printing Apparatus>

Figure 3:
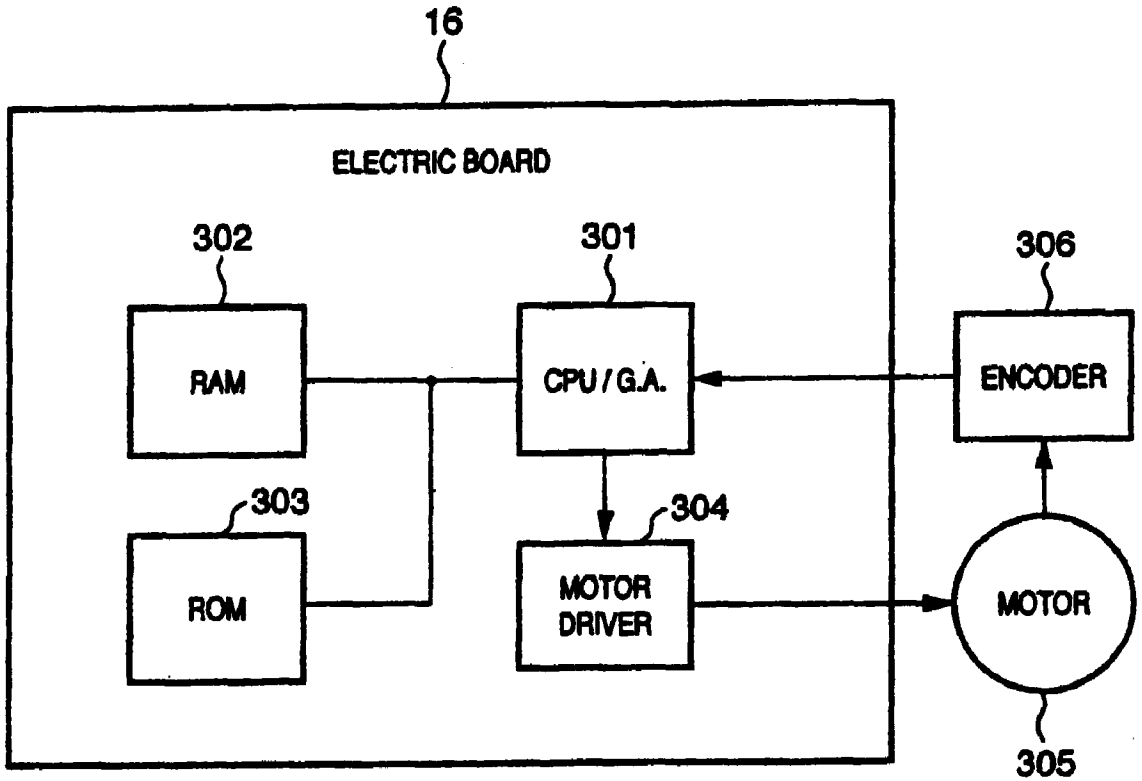
FIG. 3 is a block diagram showing a control block which controls the printing apparatus according to the first embodiment.

FIG. 3 is a block diagram showing a control block which controls the printing apparatus according to the first embodiment. Reference numeral 301 denotes a CPU/G.A. (Gate Array) which performs overall control and arithmetic processing of an ink-jet printer; 302, a RAM which temporarily stores information for controlling the printing apparatus; 303, a ROM which stores a printing apparatus operation program, various parameters, a velocity driving pattern; 304, a motor driver for driving a motor 305; and 306, an encoder which detects position information of the motor (convey roller). The motor 305 is a control target, and includes a convey motor which conveys a printing medium to the printing apparatus, and a carriage motor which drives the printhead in the scanning direction. For descriptive convenience, the motor 305 is a convey motor (25 in FIGS. 1 and 2), and the encoder 306 is an encoder sensor (32 in FIG. 1) for detecting position information of the convey motor. The ROM 303 stores a velocity driving pattern as the driving profile of the convey motor 25.

Figure 4:
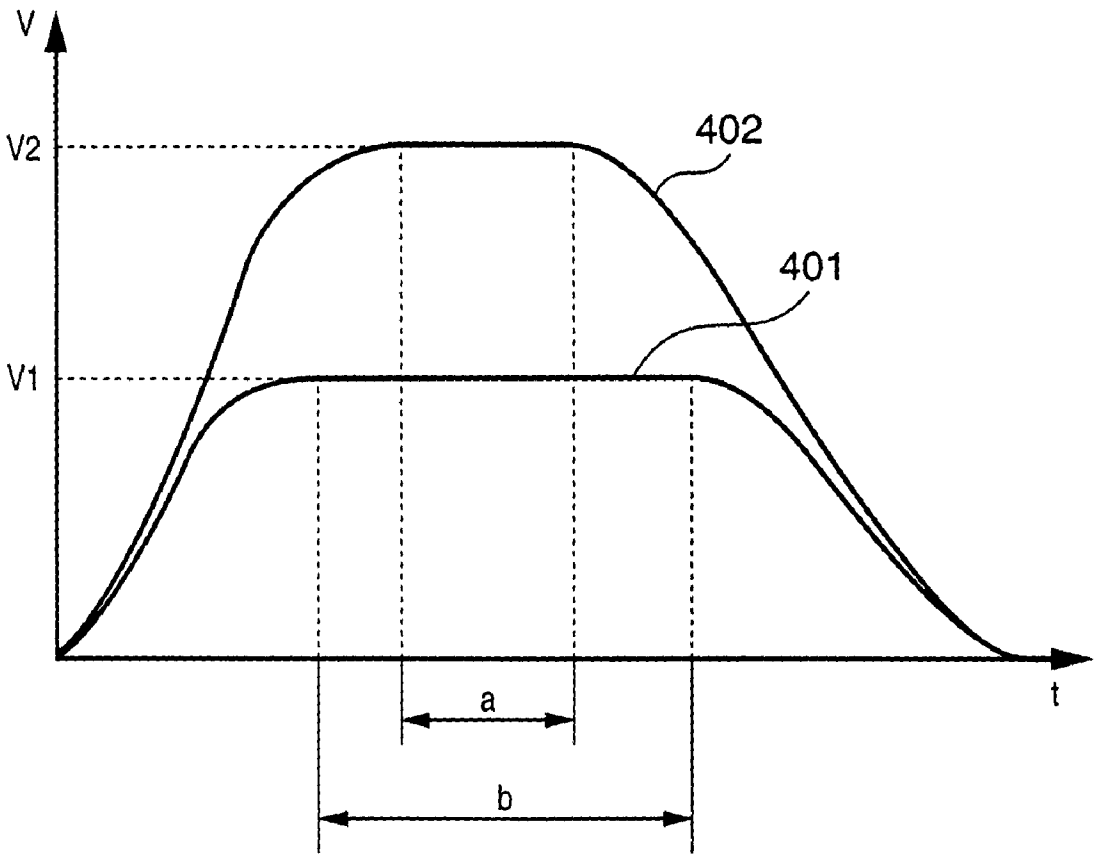
FIG. 4 is a graph showing the velocity driving pattern of a convey motor 25.

FIG. 4 shows the velocity driving pattern of the convey motor 25. The abscissa represents the time, and the ordinate represents the velocity. The slope of the pattern represents the acceleration, and the area defined by the pattern represents the convey distance.

Velocity driving patterns 401 and 402 in FIG. 4 are patterns representing high-speed driving modes. The pattern 401 is a curve for the lowest velocity (highest velocity V1) among the modes. At this velocity, operation can be ensured in an environment or state in which printing operation is assured. The pattern 402 is a driving velocity pattern capable of ending operation within a shorter time than the pattern 401 when a printing medium is moved by the same convey distance by driving the motor at a higher velocity (highest velocity V2) than that of the pattern 401 (FIG. 4 shows the difference between the highest velocities, and the convey distance is not the same). The pattern 402 is a velocity driving pattern which cannot always be used because a large motor torque is required. The ROM 303 stores a condition for selecting and changing either of the patterns, i.e., a threshold voltage. In the first embodiment, the power supply voltage is PWM-controlled and applied for driving of the convey motor 25. The control cycle is 1 ms, and servo control of the convey motor 25 is executed in this cycle. For 95% or more of a voltage value (PWM value) applied in one operation of the velocity driving pattern, i.e., motor activation, acceleration, constant-speed driving, deceleration, and stop, the condition of the threshold voltage is satisfied to change the velocity driving pattern.

As the condition of the threshold voltage, a cumulative count by which the voltage exceeds 95% or more of the PWM value (e.g., the count by which the voltage exceeds the threshold voltage is confirmed to be 10 or more) may be set as a threshold condition.

Note that the set value of the threshold condition (concrete value such as 95% or more of the PWM value or a cumulative count of 10) does not restrict the gist of the present invention, and is a parameter which is relatively determined from the characteristic of a motor used, the load characteristic of a driving target, or the like.

An increase in the load torque of the mechanical system and a change in the torque of the DC motor will be described. Generally in the mechanical system, the wear coefficient and the resistance by wear powder increase as the component wears in accordance with the use frequency and the surface state of the sliding portion changes. The component thermally expands or shrinks upon a change in ambient temperature. In a low-temperature environment, for example, the clearance between a metal shaft and a resin bearing is narrowed to increase the load torque in sliding (in a high-temperature environment, an opposite phenomenon occurs).

In the DC motor, a decrease in the magnetic force of the magnet and an increase in the resistance of a copper wire occur due to a temperature rise, and as a result, the output torque decreases. That is, even if the same voltage is applied, a desired torque may not be obtained.

In servo control in which driving control is properly performed with a motor torque almost equal to the load (including the acceleration) of the mechanical system, the torque margin of the motor can be detected by the application voltage (PWM value).

<Description of Torque Margin>

Figure 5:
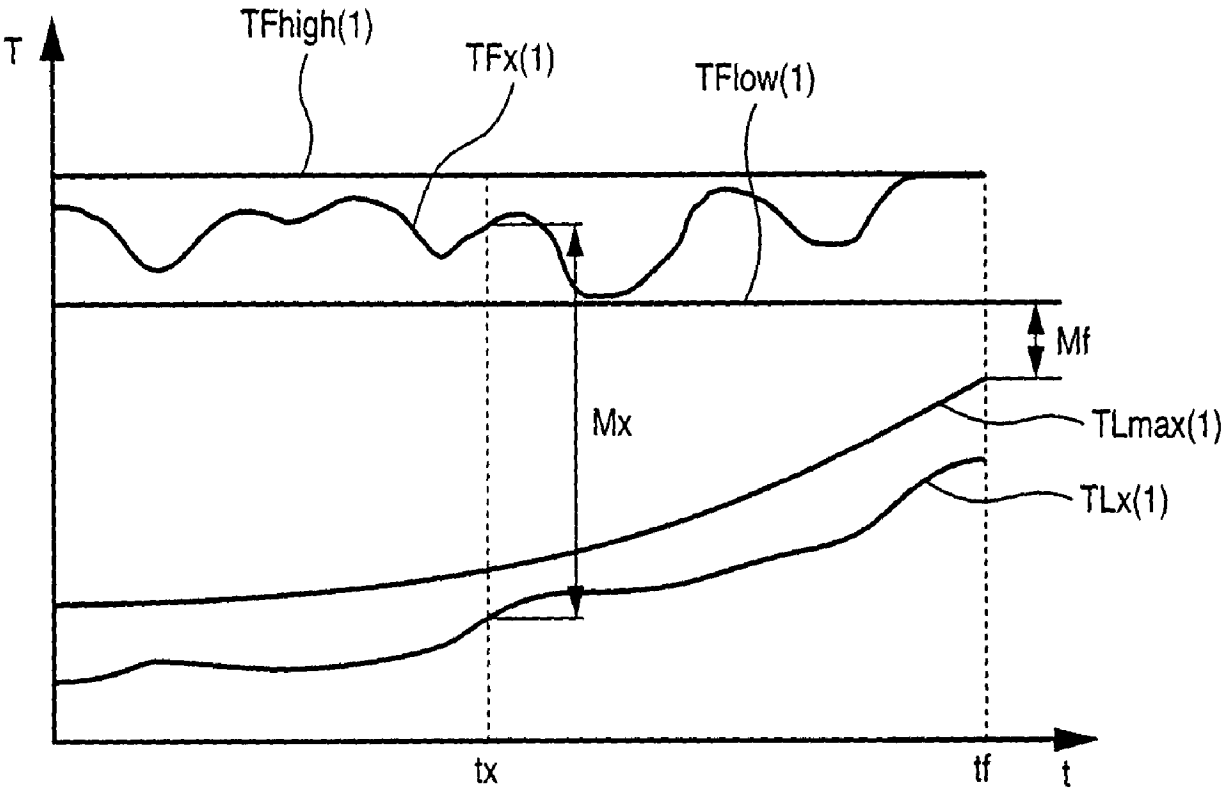
FIG. 5 is a graph showing the relationship between the motor torque and the load torque of a mechanical system in a velocity driving pattern 401 which ensures a motor torque margin.
Figure 6:
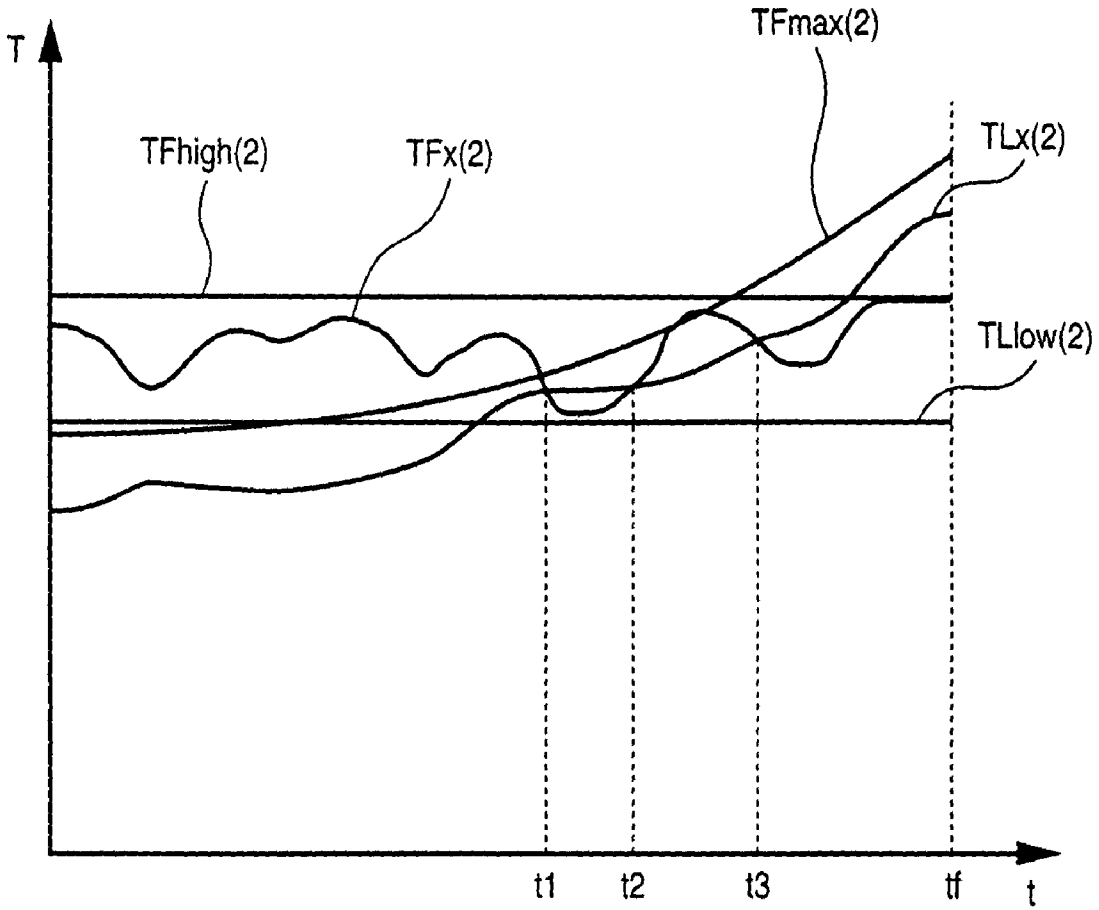
FIG. 6 is a graph showing the relationship between the motor torque and the load torque of the mechanical system in a high-velocity driving pattern 402.

FIG. 5 shows the relationship between the motor torque and the load torque of the mechanical system in the velocity driving pattern 401 which ensures a motor torque margin. FIG. 6 shows the relationship between the motor torque and the load torque of the mechanical system in the high-velocity driving pattern 402.

In FIG. 5, a use period t is plotted along the abscissa, and a torque T is plotted along the ordinate. TLmax(1) represents the maximum value (torque when all load conditions are the worst) of the load torque of the mechanical system including an environmental change and individual mechanical variations. When a given apparatus is driven in a given state, load conditions generally include a state better than the case of TLmax(1), and a load torque TLx(1) of the mechanical system exhibits a torque distribution lower than the maximum value TLmax(1). As the apparatus comes close to a product life tf, the load torque tends to rise and vary upon a change over time such as wear of a component.

In FIG. 5, TFx(1) represents the distribution of a torque output from the motor. This distribution corresponds to the motor torque in constant-speed driving when the motor is driven with the velocity driving pattern 401. The motor is controlled within a range of an upper limit TFhigh(1) of a reference motor torque to a lower limit TFlow(1) which assumes a decrease in torque owing to individual variations in motors and heat generation. Although the output torque of the motor also changes depending on the use frequency, this change is much smaller than an increase in the load torque of the mechanical system, and a description thereof will be omitted.

The velocity driving pattern 401 shown in FIG. 4 assures operation in any use environment or condition. For this purpose, a predetermined torque margin must exist between the maximum load torque (TLmax(1)) of the mechanical system and the lower limit of the motor output torque. In this case, in the distribution of the torque TLmax(1) of the mechanical system, a predetermined torque margin must exist between a torque at the product life tf that gives the maximum value and the lower limit TFlow(1) of the motor output torque. The difference between the output torque of the motor and the load torque of the mechanical system is called a "torque margin". In FIG. 5, the torque margin at the maximum value TLmax(1) and the product life tf is Mf. The torque margin Mf is a value obtained on the assumption of the strictest conditions of these torques.

In FIG. 5, the torque margin based on actual driving of the motor and mechanical system at time tx is MX(TFx(1)−TLx(1)), and an excessive torque margin is given in comparison with a torque margin Mf which assumes the strictest condition.

FIG. 6 is a graph showing the relationship between the time and the torque distribution in the higher-velocity driving pattern 402 than the pattern 401.

TLmax(2) represents the maximum value of the load torque of the mechanical system including an environmental change and individual mechanical variations, and TLx(2) represents the distribution of the load torque of an actual mechanical system. Similar to TLx(1) in FIG. 5, as TLx(2) comes close to the product life tf, the load torque tends to rise and vary upon a change over time such as wear of a component. TFhigh(2) represents the upper limit of the motor torque, and TFlow(2) represents the lower limit of the motor torque. TFx(2) represents the distribution of a torque actually output from the motor.

As the driving velocity increases, the distributions TLmax(2) and TLx(2) of the load torque of the mechanical system exhibit values larger than TLmax(1) and TLx(1) shown in FIG. 5 under the influence of wear depending on the velocity or the like.

The motor torques TFx(2), TFhigh(2), and TFlow(2) are values smaller than TFx(1), TFhigh(1), and TFlow(1) because of electrical and mechanical DC motor characteristics.

Hence, the torque margin in the velocity driving pattern 402 is smaller than that in the velocity driving pattern 401. The motor torque TFx(2) is not always larger than the load torque TLx(2) of the mechanical system, and the magnitude relationship may be reversed. The load torque TLx(2) of the mechanical system becomes larger than the motor torque TFx(2) at the interval between time t1 and time t2 and the interval between time t3 and time tf in FIG. 6. These intervals are regions where no torque margin is ensured. At these intervals, driving of the motor by the velocity driving pattern 402 results in overload.

When no torque margin can be ensured, like the above-mentioned intervals (between t1 and t2 and between t3 and tf), control is switched to, e.g., a velocity driving pattern which can ensure a torque margin in the entire region as shown in FIG. 5, thereby ensuring a torque margin. Detailed control of selectively changing the velocity driving pattern and ensuring a torque margin in accordance with the driving state will be explained with reference to FIG. 7.

The velocity driving pattern 401 capable of ensuring a torque margin is applied to an overload region on the basis of control which adopts the velocity driving pattern 402. This realizes high-speed motor driving, and motor driving efficiently using the motor performance without any excessive margin.

At time t1, time t2, and time t3 in FIG. 6, the driving torque TFx(2) of the motor and the load torque TLx(2) of the mechanical system are equal to each other. This is equivalent to a state in which 100% of the application voltage (PWM value) is applied.

At an interval at which a torque margin is ensured, i.e., an interval other than the interval between time t1 and time t2 and the interval between the time t3 and time tf, TFx(2)> TLx(2) holds, a margin is ensured, and the application voltage (PWM value) is less than 100%.

The CPU/G.A. 301 obtains velocity information on the basis of position information (output pulse) fed back from the encoder 306. The CPU/G.A. 301 calculates the deviation (proportional term, differential term, integral term, and the like) between the position information, the velocity information, and a target value (driving table). The CPU/G.A. 301 executes servo control for the deviation to generate application voltage information.

The application voltage information is utilized in determination of whether a torque margin exists, and change of the velocity driving pattern (to be described later).

<Change of Velocity Driving Pattern>

Figure 7:
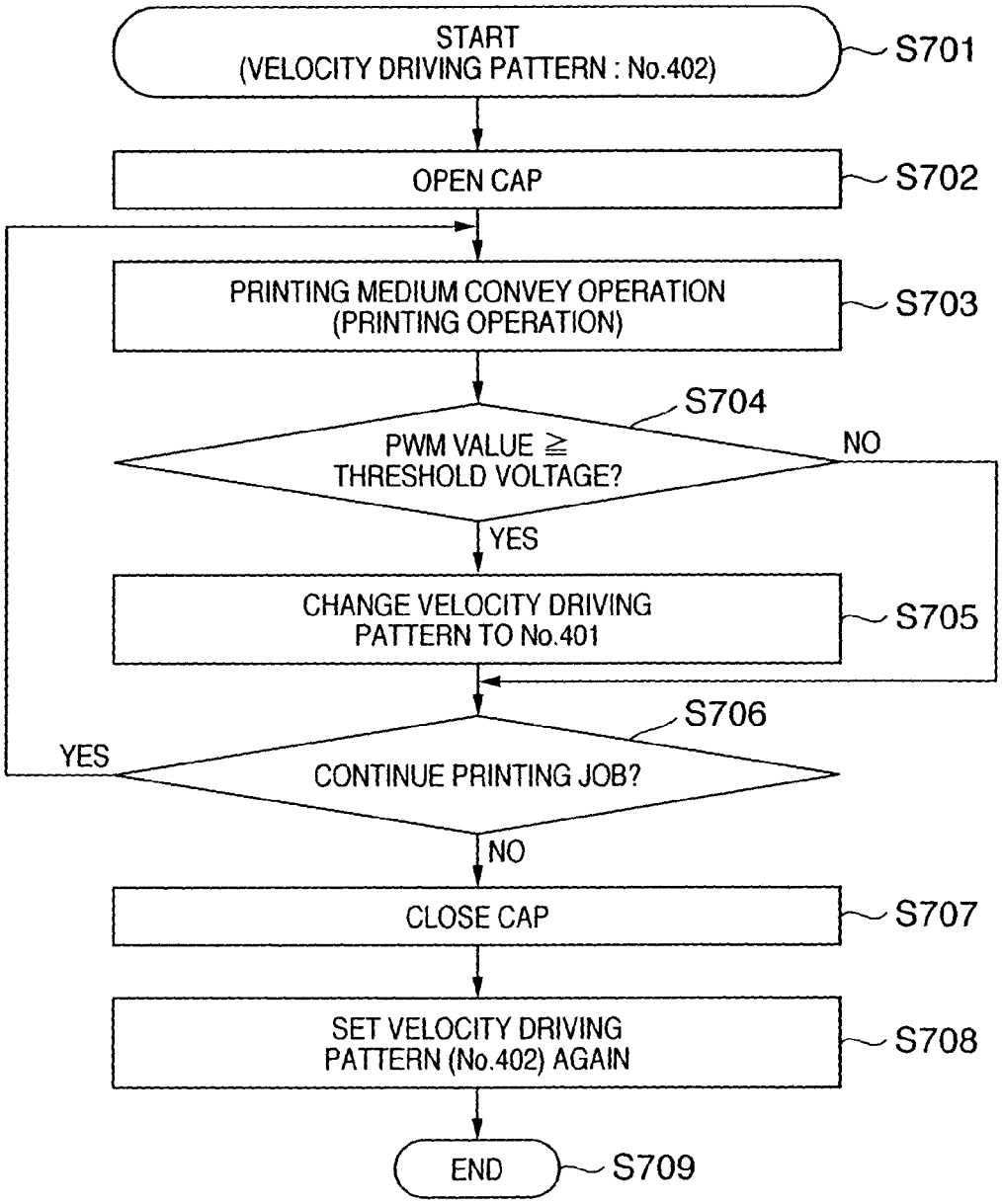
FIG. 7 is a flow chart for explaining a control flow of selectively changing the velocity driving patterns 401 and 402 according to the first embodiment.

FIG. 7 is a flow chart for explaining a control flow of selectively changing the velocity driving patterns 401 and 402. In step S701, a printing job to be processed by the printing apparatus is generated, and the flow starts. At this time, the higher-velocity pattern 402 (FIG. 4) is given as a default velocity driving pattern. In step S702, capping of the head cartridge 7 with the cap 21 for maintenance is canceled (cap is opened).

In step S703, a printing medium is conveyed, and printing operation starts. An application voltage (PWM value) to be applied to the convey motor 25 is determined from information of the encoder sensor 32 in accordance with the load of the mechanical system and the state of the convey motor 25, and the motor is driven (S703).

Whether information on the application voltage (PWM value) has reached a threshold voltage (e.g., 95% of a voltage in constant-speed running (portion a in FIG. 4) in each velocity driving pattern) is determined (S704). Determination based on the application voltage obtains the relative relationship between the driving torque TFx(2) output from the motor and the load torque TLx(2) of the mechanical system, as described with reference to FIG. 6.

If the application voltage (PWM value) is equal to or more than the threshold voltage (YES in S704), the processing advances to step S705 to change the velocity driving pattern 402 to the velocity driving pattern 401 (if the velocity driving pattern has already been the pattern 401, the velocity driving pattern 401 is kept unchanged). In order to ensure a torque margin, the velocity driving pattern 402 is changed to the lower-velocity driving pattern 401 which does not require any motor torque. Based on the changed pattern, the motor driver 304 controls the motor to execute the printing job.

In step S706, whether to continue the printing job is determined, and if YES in step S706, the processing returns to step S703 to continue printing operation.

If the application voltage (PWM value) does not reach the threshold voltage (NO in S704) (e.g., the load torque of the mechanical system is not large, or the torque of the convey motor 25 does not decrease), the processing advances to step S706 with the current settings without changing the velocity driving pattern. If the printing job is determined to continue (YES in S706), the processing returns to step S703 to continue printing operation.

If the printing job is determined to end (NO in S706), the processing advances to step S707 to shift to capping operation.

In step S708, the set velocity driving pattern is initialized, the default velocity driving pattern 402 is set again, and the flow ends (S709). The velocity driving pattern 402 which has become unavailable is set again because, when heat generation of the motor settles upon the lapse of a time in an idle state, the motor characteristic is restored and a torque margin can be ensured. The motor is hardly cooled within a short time, but the lapse of a given time is predicted at the timing of the next printing job (the velocity driving pattern 402 may be set again at the timing when the overload of the motor is estimated (predicted) to be canceled).

Re-setting of the velocity driving pattern is not limited to the printing end timing. The velocity driving pattern may be set again at another timing when cooling of the motor is predicted. The cooling time may be actually counted to set the velocity driving pattern again upon the lapse of a predetermined cooling time.

The threshold condition "95%" is a margin for assuring operation by the pattern 402 when the velocity driving pattern 402 is set again. This value is not limited to the threshold condition, but can be determined by an experiment or calculation.

A processing step of confirming selection of the velocity driving pattern 402 before printing operation may also be added before printing operation. In the above example, two velocity driving patterns can be selected. The number of patterns may be increased to set a torque margin stepwise, which realizes finer motor control.

In addition, in the embodiment, though the motor controlling which includes the acceleration region, the constant-speed region, and the deceleration region, is explained as shown in FIG. 4, it is possible to apply also for the motor controlling only by constant-speed driving, for example, in cases where the carriage moves a comparatively short distance in order to perform recovery operation. In this case, a velocity driving pattern for the constant-speed driving is changed by the motor controlling.

The first embodiment has exemplified control following a velocity driving pattern on the basis of the pattern which is determined by velocity information and time information. However, the profile is not limited to this, and may be a movement profile determined by time information and position information as far as the printing velocity performance changes.

Voltage control of changing the voltage has been described as a servo control method of controlling a motor, but the present invention can also be easily applied to current control of changing the current. At this time, a change in the load of the mechanical system can be similarly grasped even by variations in current value.

However, the relationship with the voltage more greatly changes upon a change in torque including heat generation of the motor in terms of the DC motor characteristic, and a decrease in torque can be easily obtained. Servo control is, therefore, preferably executed using the voltage as information.

The first embodiment has described the torque (voltage) margin in a constant-speed region. The present invention can also be applied to an acceleration region, deceleration region, or entire region.

The control target is the convey motor 25, but may be the sheet feed motor 28, carriage motor 13, or another motor as long as servo control is adopted. When the carriage motor 13 is to be controlled, the ink discharge frequency is changed in accordance with the carriage scanning speed in order to form an image in printing.

According to the first embodiment, a plurality of velocity driving patterns are set in advance. The presence/absence of a torque margin is determined from a comparison between the threshold voltage and the application voltage. The velocity driving pattern can be selectively switched on the basis of the determination result. Switching of the velocity driving pattern prevents an excessive margin owing to the difference in use state or environment, and high-performance motor driving can be realized.

Second Embodiment

The first embodiment targets a DC motor as a convey motor which can be feedback-controlled, and has explained control of switching the velocity driving pattern in accordance with the torque margin. The second embodiment will describe switching control of the velocity driving pattern that targets, as a sheet feed motor 28, a stepping motor subjected to not feedback control but open-loop control.

Similar to the DC motor, the stepping motor decreases in driving torque upon heat generation along driving of the motor. If the stepping motor runs short of the torque margin owing to a decrease in driving torque, a so-called step-out phenomenon in which the motor cannot be rotated occurs. To ensure driving of the stepping motor, the torque margin must be reliably ensured.

Similar to the DC motor, the stepping motor also has an excessive torque margin in normal driving. In the stepping motor which is controlled by an open loop, information based on driving is not fed back, and it is difficult to directly obtain a torque margin, unlike the first embodiment. In the second embodiment, therefore, the torque margin of the stepping motor is estimated using a torque margin obtained for the above-described DC motor, and the velocity driving pattern is switched to control the stepping motor.

When the printing apparatus executes normal printing processing, the use frequencies of a convey motor (DC motor) 25 and the sheet feed motor (stepping motor) 28 are almost equal to each other. The relationship between heat generation of the convey motor (DC motor) 25 and sheet feed motor (stepping motor) 28 and a decrease in torque on the basis of the use frequency is obtained in advance. The switching timing of the velocity driving pattern of the DC motor and the threshold condition can be estimated for the stepping motor to control the stepping motor.

When the convey velocity and sheet feed velocity must be synchronized with each other, the switching timing of the velocity driving pattern of a motor having a smaller torque margin among the convey motor 25 and sheet feed motor 28 is used as a reference. The switching timing of the velocity driving pattern of the other motor is synchronized (timing is estimated), and the velocity driving patterns are simultaneously changed. In this manner, the two motors can be synchronized without any operation noncoincidence.

For example, the torque margin relationship between the convey motor (DC motor) 25 and the sheet feed motor (stepping motor) 28 is as follows in each case.

(1) Torque Margin of Stepping Motor≧Torque Margin of DC Motor

The torque margin in this case is obtained using the switching timing of the velocity driving pattern of the DC motor as a reference because the torque margin of the DC motor serves as a critical condition. The synchronized timing is estimated as the switching timing of the velocity driving pattern of the stepping motor, and the velocity driving pattern of the stepping motor is switched. The two motors can ensure proper torque margins which are not overloads, and can achieve high-performance operation.

(2) Torque Margin of DC Motor>Torque Margin of Stepping Motor

As described above, it is difficult to directly obtain the torque margin of the stepping motor. In this case, a threshold (first threshold) used to determine switching of the velocity driving pattern of the single DC motor is set as a threshold (second threshold) having a lower value than that for the single DC motor in consideration of the relationship between heat generation of the stepping motor and a decrease in torque. The switching timing of the velocity driving pattern of the DC motor is obtained on the basis of the set second threshold (estimated value). The synchronized timing is estimated as the switching timing of the velocity driving pattern of the stepping motor, and the velocity driving pattern of the stepping motor is switched. The two motors can ensure proper torque margins which are not overloads, and can realize high-performance operation.

As a detailed processing flow, in the flow chart of FIG. 7 according to the first embodiment, a velocity driving pattern (corresponding to 402 in FIG. 4) for driving the sheet feed motor (stepping motor) 28 and convey motor (DC motor) 25 at a high speed is selected in step S701. If the velocity driving pattern of the convey motor (DC motor) 25 is switched in accordance with the PWM value of the convey motor (DC motor) 25 in step S704 (YES in S704), the driving pattern of the sheet feed motor (stepping motor) 28 is also changed in step S705 to a velocity driving pattern (corresponding to 401 in FIG. 4) for low-speed driving.

When the magnitude relationship between the threshold voltage and the PWM value of the convey motor (DC motor) 25 is compared in step S704, the threshold voltage of the single DC motor is set in a comparison in case (1). In a comparison in case (2), a threshold voltage having a lower value than that of the threshold voltage for the single DC motor is set as an estimated value.

In this way, a PWM value and threshold (first threshold) obtained for the DC motor are utilized for the stepping motor whose torque margin is difficult to directly estimate. High-driving-efficiency operation almost free from an excessive torque margin for the stepping motor driven by an open loop can be realized.

The contents of the second embodiment are not limited to the relationship between the convey motor and the sheet feed motor, and may be applied to a combination of other motors which are related to each other in terms of the operation and torque margin. The target motor is not limited to the stepping motor.

In the second embodiment, the driving pattern of a motor which is not feedback-controlled is changed on the basis of driving information of a feedback-controlled motor. The driving pattern of another feedback-controlled motor may be changed on the basis of the driving information. In this case, the margin need not be monitored for each of motors, and software processing can be reduced.

Third Embodiment

Figure 8:
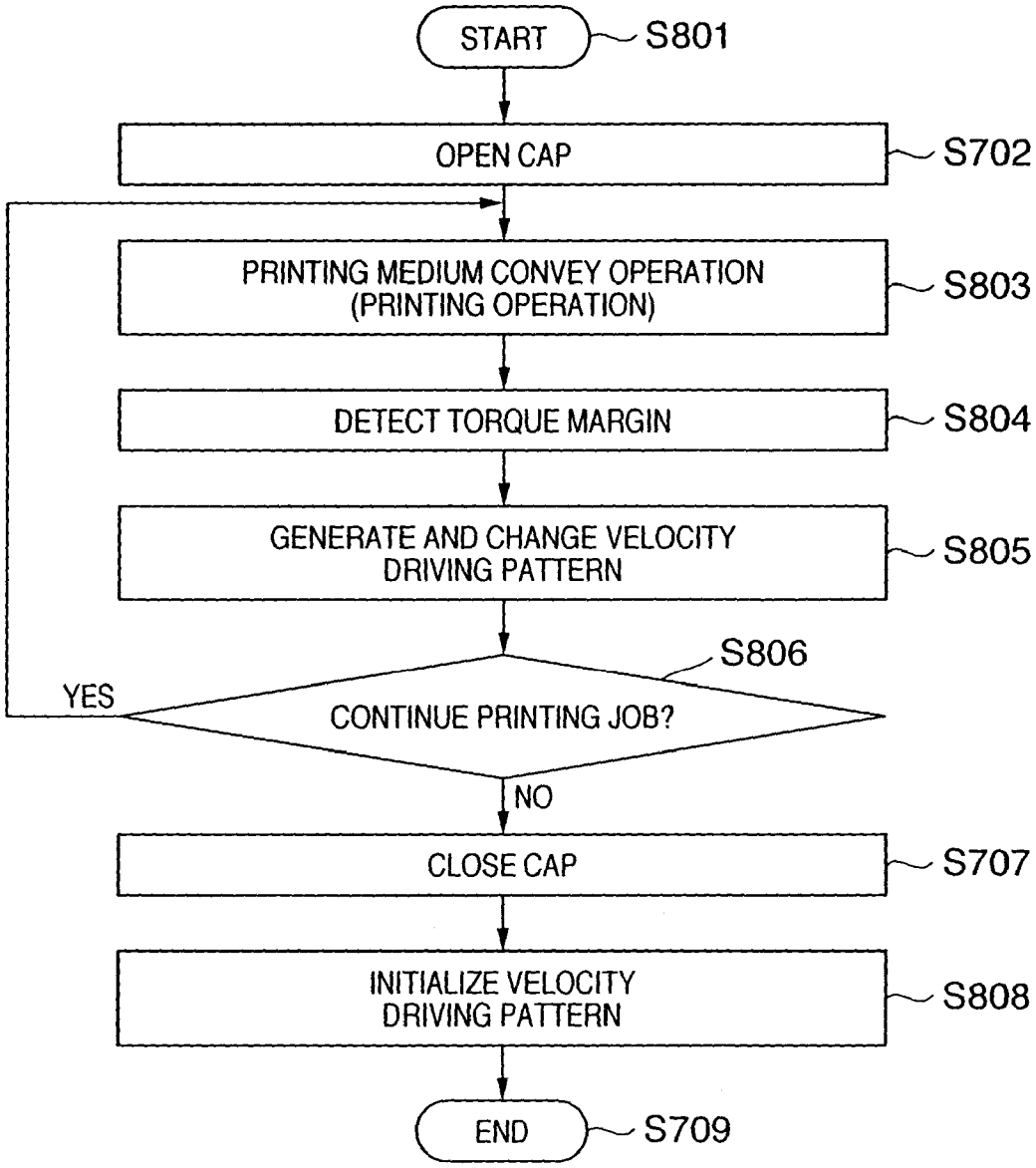
FIG. 8 is a flow chart for explaining a processing flow of generating a velocity driving pattern and switching control according to the third embodiment.

An embodiment in which a velocity driving pattern is automatically generated instead of selecting a predetermined velocity driving table in the first embodiment will be described. In the flow chart of FIG. 8, printing operation is performed with a default velocity driving pattern (S803), and the torque margin is calculated from the application voltage (PWM value) in operation (S804). The torque margin can be obtained from the relative relationship between the application voltage and the threshold voltage used in step S704 of FIG. 7. For example, at time t1, time t2, and time t3 in FIG. 6, the driving torque TFx(2) of the motor and the load torque TLx(2) of the mechanical system are equal to each other. This is equivalent to a state in which 100% of the application voltage (PWM value) is applied. In this case, no torque margin exists.

In step S805, an acceleration region, constant-speed region, and deceleration region are set, and the velocity driving pattern is so changed as to ensure a proper torque margin (S805). In changing the velocity driving pattern, only the moving distance (position) and highest velocity are given, and a velocity driving pattern (information such as an acceleration condition and moving time) can be generated on the basis of the pieces of information. The highest velocity is controlled by the application voltage for driving the motor, and the highest velocity which can be set is determined from the relationship with the torque margin obtained in step S804.

As for change of the velocity driving pattern, the difference between a torque margin detected in step S803 and an allowable torque margin (e.g., a minimum torque margin (minimum motor output torque—maximum load torque) which must be ensured, such as Mf shown in FIG. 5), and a coefficient such as the magnification can be obtained. The highest velocity and acceleration of a default velocity driving pattern can be changed in accordance with the coefficient. As a means for setting a detected torque margin (detected value) close to an allowable torque margin (target value), a control theory such as PID control can also be applied.

While job processing continues (S803 to S806), a velocity driving pattern which ensures a proper margin is generated and changed, thereby enabling high-driving-efficiency control which fully exploits the motor performance. The first embodiment has described the change of the velocity driving pattern in which the driving velocity decreases. According to the third embodiment, a higher-velocity pattern (higher-velocity pattern than the pattern 402 of FIG. 4) can be generated from the relationship with an allowable torque margin to switch to higher-velocity control.

In this case, a default velocity driving pattern can be replaced with a newly generated high-velocity driving pattern to further improve the performance of initial operation at the start of printing.

In the above embodiments, droplets discharged from the printhead of the printing apparatus are ink, and a liquid contained in the ink tank is ink. The content of the ink tank is not limited to ink. For example, the ink tank may contain a processing solution to be discharged onto a printing medium in order to increase the fixing properties, water resistance, or quality of a printed image.

Of ink-jet printing systems, the embodiments can adopt a system which comprises a means (e.g., an electrothermal transducer or laser beam) for generating heat energy as energy utilized to discharge ink and changes the ink state by heat energy. This ink-jet printing system can increase the printing density and resolution.

As a representative arrangement or principle, the present invention preferably adopts the basic principle disclosed in, e.g., U.S. Pat. No. 4,723,129 or 4,740,796. This system is applicable to both a so-called on-demand apparatus and continuous apparatus. The system is particularly effective for the on-demand apparatus because of the following reason. That is, at least one driving signal which corresponds to printing information and gives a rapid temperature rise exceeding nucleate boiling is applied to an electrothermal transducer arranged in correspondence with a sheet or liquid channel holding a liquid (ink). This signal causes the electrothermal transducer to generate heat energy, and causes film boiling on the heat effecting surface of the printhead. Consequently, a bubble can be formed in the liquid (ink) in one-to-one correspondence with the driving signal.

Growth and shrinkage of the bubble discharge the liquid (ink) from an orifice, forming at least one droplet. The driving signal more preferably has a pulse shape because a bubble grows and shrinks instantaneously at an appropriate timing to discharge the liquid (ink) with high response.

The pulse-like driving signal is preferably a signal disclosed in U.S. Pat. No. 4,463,359 or 4,345,262. Conditions disclosed in U.S. Pat. No. 4,313,124 which is an invention concerning the temperature rise ratio of the heat effecting surface can provide higher-quality printing.

It is also possible to employ a cartridge type printhead described in the embodiments in which an ink tank is integrated with a printhead itself, or an interchangeable chip type printhead which can be electrically connected to an apparatus main body and receive ink from the apparatus main body when attached to the apparatus main body.

It is preferable to add a printhead recovery means or preliminary means to the arrangement of the above-described printing apparatus because printing operation can further stabilize. Practical examples of the additional means are a capping means for the printhead, a cleaning means, a pressurizing or suction means, an electrothermal transducer, another heating element, and a preliminary heating means as a combination of the electrothermal transducer and heating element. A predischarge mode in which discharge is performed independently of printing is also effective for stable printing.

The printing mode of the printing apparatus is not limited to a printing mode using only a main color such as black. The apparatus can adopt at least either a composite color mode using different colors or a full color mode using a color mixture, regardless of whether the printhead is an integral printhead or a combination of printheads.

The above-described embodiments assume that ink is a liquid. It is also possible to use ink which solidifies at room temperature or less and softens or liquefies at room temperature. A general inkjet system performs temperature control such that the viscosity of ink falls within a stable discharge range by adjusting the ink temperature within the range of 30° C. (inclusive) to 70° C. (inclusive). Hence, ink need only liquefy when applied with a printing signal.

In order to prevent a temperature rise caused by heat energy by positively using the temperature rise as energy of the state change from the solid state to the liquid state of ink, or to prevent evaporation of ink, ink which solidifies when left to stand and liquefies when heated can be used. In any case, the present invention is applicable to any ink which liquefies only when heat energy is applied, such as ink which liquefies when applied with heat energy corresponding to a printing signal and is discharged as liquid ink, or ink which already starts to solidify when arriving at a printing medium.

The object of the present invention is also achieved when a storage medium which stores software program codes for realizing the functions of the above-described embodiments is supplied to a system or apparatus, and the computer (or the CPU or MPU) of the system or apparatus reads out and executes the program codes stored in the storage medium.

In this case, the program codes read out from the storage medium realize the functions of the above-described embodiments, and the storage medium which stores the program codes constitutes the present invention.

The storage medium for supplying the program codes includes a floppy disk, hard disk, optical disk, magnetooptical disk, CD-ROM, CD-R, magnetic tape, nonvolatile memory card, and ROM.

The functions of the above-described embodiments are realized when the computer executes the readout program codes. Also, the functions of the above-described embodiments are realized when an OS (Operating System) or the like running on the computer performs part or all of actual processing on the basis of the instructions of the program codes.

The functions of the above-described embodiments are also realized when the program codes read out from the storage medium are written in the memory of a function expansion board inserted into the computer or the memory of a function expansion unit connected to the computer, and the CPU of the function expansion board or function expansion unit performs part or all of actual processing on the basis of the instructions of the program codes.

When the present invention is applied to the storage medium, the storage medium stores program codes corresponding to the above-described flow charts (shown in FIG. 7 and/or 8).

As has been described above, according to the present invention, the presence/absence of a torque margin is determined from a comparison between the threshold voltage and the application voltage (PWM value). The velocity driving pattern can be selectively switched on the basis of the determination result. Switching of the velocity driving pattern prevents an excessive margin owing to the difference in use state or environment, and printing by high-performance motor driving can be achieved.

As many apparently widely different embodiments of the present invention can be made without departing from the spirit and scope thereof, it is to be understood that the invention is not limited to the specific embodiments thereof except as defined in the claims.

What is claimed is:

1. A printing apparatus having first and second motors used for printing and a printing controller for feedback controlling driving of the first motor based on a first driving pattern and open-loop controlling driving of the second motor based on the first driving pattern, the printing controller comprising:

control information generation means for generating control information for a driving torque of the first motor, while the first motor is driven based on the first driving pattern;

comparison means for comparing control information of the first motor and a threshold for determining an overload on driving of the first motor; and setting means for setting second driving patterns corresponding to the first and second motors, instead of the first driving pattern, based on a comparison result of said comparison means.

2. The apparatus according to claim 1, wherein the first motor comprises a DC motor, and the second motor comprises a stepping motor.

3. The apparatus according to claim 1, wherein the first motor comprises a conveying motor, and the second motor comprises a feeding motor.

4. A method of controlling a printing apparatus having first and second motors used for printing and a printing controller for feedback controlling driving of the first motor based on a first driving pattern and open-loop controlling driving of the second motor based on the first driving pattern, the method comprising:

a control information generation step of generating control information for a driving torque of the first motor, while the first motor is driven based on the first driving pattern;

a comparison step of comparing control information of the first motor and a threshold for determining an overload on driving of the first motor; and a setting step of setting second driving patterns corresponding to the first and second motors, instead of the first driving pattern, based on a comparison result of the comparison step.

* * * * *